United States Patent [19]

Brutosky

[11] Patent Number: 4,735,367

[45] Date of Patent: Apr. 5, 1988

[54] CAN CRUSHER

[76] Inventor: Andrew J. Brutosky, P.O. Box 883, Choteau, Mont. 59422

[21] Appl. No.: 897,273

[22] Filed: Aug. 18, 1986

[51] Int. Cl.[4] ..... B02C 23/04

[52] U.S. Cl. ..... 241/37.5; 100/98 R; 100/151; 100/902; 241/99; 241/200

[58] Field of Search ..... 241/37.5, 99, 200; 100/902, 151, 152, 153, 154, 156, 210, 296, 98 R

[56] References Cited

U.S. PATENT DOCUMENTS

| | | | |
|---|---|---|---|
| 2,619,150 | 11/1952 | Smith | 241/99 X |
| 3,138,090 | 6/1964 | Moorehead | 241/99 X |
| 3,687,062 | 8/1972 | Frank | 241/99 X |
| 3,749,004 | 7/1973 | Pagdin et al. | 241/99 X |
| 3,951,059 | 4/1976 | Morris | 241/99 X |
| 3,960,070 | 6/1976 | McClure et al. | 241/99 X |
| 4,261,259 | 4/1981 | Beardslee | 241/99 X |
| 4,373,435 | 2/1983 | Grevich | 241/99 X |
| 4,501,198 | 2/1985 | Johansson et al. | 100/902 X |

FOREIGN PATENT DOCUMENTS

| | | | |
|---|---|---|---|
| 129222 | 12/1984 | European Pat. Off. | 241/37.5 |

*Primary Examiner*—Howard N. Goldberg
*Assistant Examiner*—Joseph M. Gorski
*Attorney, Agent, or Firm*—Breneman & Georges

[57] ABSTRACT

Apparatus for crushing cans or the like comprises a conveyor formed from a plurality of endless chains cooperating with a fixed inclined crushing plate converging toward the discharge end of the conveyor. The crushing plate includes an actuator strip-like member hinged to the plate which when depressed engages an electrical switch to operate a drive mechanism for the conveyor. A can deposited into the apparatus depresses the actuator which operates the electrical switch to start the drive mechanism. The can is gripped by the chain conveyor and pulled downward between the conveyor and crushing plate flattening the can. When the flattened can exits the crushing apparatus the actuator is released stopping the drive mechanism. A support housing for the apparatus is provided with an opening for receiving cans which is spaced a distance from the crushing plate and conveyor to reduce the risk of injury.

10 Claims, 4 Drawing Sheets

FIG. 8
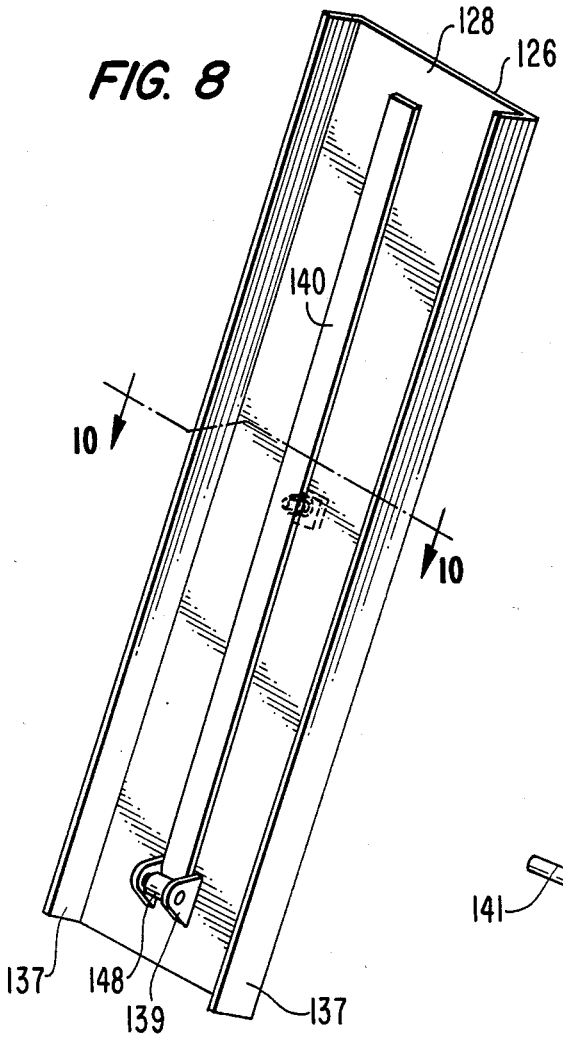
FIG. 9
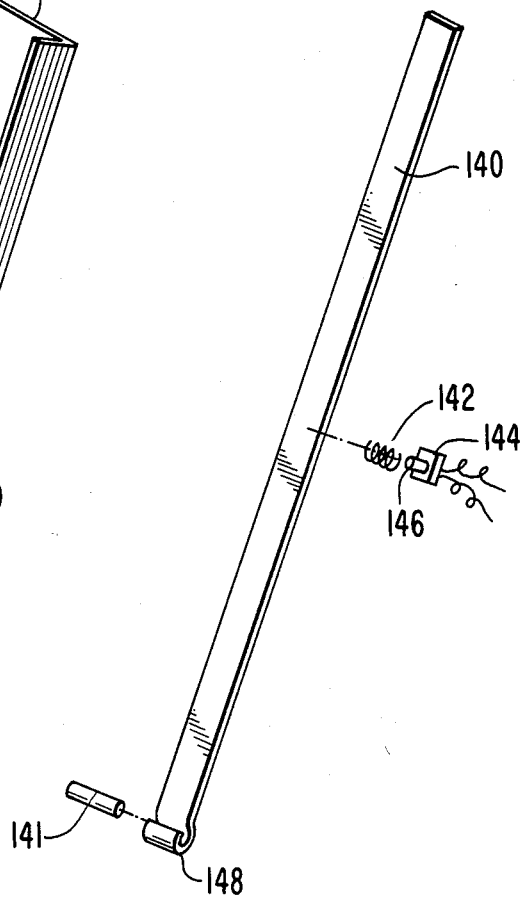
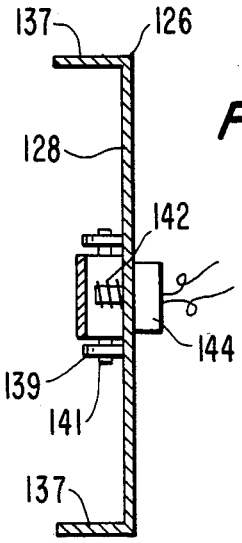
FIG. 10

CAN CRUSHER

BACKGROUND OF THE INVENTION

1. Field of the Invention

The present invention pertains to a device for crushing or flattening compressible or malleable materials such as circular food and beverage cans. More particularly the invention relates to a can crushing apparatus for use in the home ergonomically designed to prevent injury to children and individuals in the household while effectively compressing cans commonly used in the food and beverage industry.

2. Description of the Prior Art

The importance of recycling materials and environmental concerns has resulted in the introduction and utilization of a number of devices for compacting and crushing aluminum beverage cans. Some of these prior art devices are suitable for crushing aluminum and other soft metals but are not of sufficient power to crush and properly dispose of steel, food and beverage cans that have been utilized. These devices also have not been designed ergonomically to prevent injury to children and the user of the can crusher who may inadvertently or accidentally place his hand in the device to free a can that becomes lodged in the mechanism.

In addition to the devices available for recycling of cans in the prior art are waste disposal and litter compactors designed to crush, shred or compact cans to assist in their removal and waste disposal. In this regard several states have recently enacted antipolution laws requiring a deposit on all containers which would not otherwise be required thereby resulting in separate handling of food and beverage containers from trash and garbage in general. In such instances it is desirable to reduce the volume of food and beverage containers to ease the burden of handling of such empty containers.

The prior art includes a number of devices for compacting trash and for crushing cans. Some of the prior art compacting devices such as Talley U.S. Pat. No. 4,358,994 employs a compacting device that applies a force transverse to the axis of the can to essentially fold the can in half and then compress the can to a flat configuration. U.S. Pat. No. 4,358,994 is of further interest in providing a device to prevent accidental injury from cans becomming jammed in the can crushing device. Other representative prior art devices such as U.S. Pat. Nos. Malarsky 3,036,517 and Bailey 4,442,768 employ mechanical jaw-like members which may be manually or motor activated to crush cans. Other commonly employed compactors or can crushers are represented in prior art such as U.S. Pat. Nos. Skipworth 4,432,278 and Volemer 2,448,184 which employ a pair of angularly disposed conical discs that are rotated to define a wedge shaped opening of diminishing size for crushing cans.

U.S. Pat. Nos. Rosenow 3,827,351, Bruton 1,766,327 and Swendeman 4,432,279 employ the synchronization of rollers or cutters principly for flattening or shredding metal cans. The rollers in Rosenow's device have substantially square cross-sections with rounded edges. This provides a vise-like action at the flat surfaces of the rollers which flattens and crushes cans entrapped therein. Bruton's device provides a series of teeth in a cooperating relationship which impale and cut the metal cans. Swendeman's can flattener includes a single rotating drum cooperating with a series of roller assemblies mounted in an arc converging with the drum.

Daily U.S. Pat. 4,369,699 discloses a can folding and flattening device including a rotating element which crushes the can against a fixed wall compression plate.

Still another variety of crushing device is disclosed in Kanna U.S. Pat. Nos. 3,645,199 Near 2,150,984 and Wagley 3,691,942. 3,645,199 and 2,150,984 provide a pair of opposing horizontal conveyors which converge toward their discharge end. A can or other metal article is placed between the conveyors whereby the article is crushed. Wagley provides a pair of vertically oriented conveyor belts which converge toward their lowermost end. The conveyor uses a single drive chain with a series of crusher plates attached thereto. An opening in the upper portion of the housing allows a can to be dropped between the converging conveyors where it is crushed and deposited into a receiving tray.

All of the above-noted devices are relatively complex. Those which require two synchronized rollers or belts are relatively elaborate and require the use of gearing to obtain the necessary synchronization. Many of the rollers are specially shaped which further tend to increase the manufacturing costs of the device.

The combination of a rotary cylinder and a fixed wall compression plate of the prior art frequently results in the material becoming jammed between the roller and plate. To avoid jamming, the compression plates are spring loaded so as to retract under high loads which would normally have resulted in jamming. This arrangement still did not completely correct the problem of jamming. Moreover, the additional moving parts were integrated into the device which resulted in a greater cost and greater potential for malfunction.

There is accordingly a need for a device capable of crushing or compressing malleable materials which is reliable, inexpensive to manufacture and safe and effective to operate. The operation of such devices pose several safety questions in operation around children and in becomming accidently jammed. This is particularly evident in the home where small children may come in contact and use the crushing device in an unsafe manner or through carelessness or lack of awareness of the risk of serious injury. It is therefore of significant importance that a compressor or crusher include safety features in order to avoid the risk of injury.

The present invention is directed to a compactor or crusher intended to be suitable for use in the home or workplace. The invention provides a relatively simple and inexpensive device for flattening or crushing malleable material and in particular empty circular food and beverage cans of aluminum or steel construction for subsequent disposal or recycling. The device is designed in such a manner as to significantly reduce the risk of injury to the user by employing a circular opening of a specific size in relation to a crushing mechanism distanced ergonomically from the circular opening. More specifically the safety features include an arrangement of components that prevents the user from inadvertantly placing their hands or fingers in danger of the moving parts. In addition, the device is provided with a safety switch to activate the moving crushing elements only when the can or article is placed in the device. Thus should one put their hand inadvertantly into the crusher, the likelihood of serious injury due to the moving parts is substantially eliminated.

The invention is also relatively easy and inexpensive to manufacture, install, operate and maintain. Compared to many of the previously known devices, the invention has relatively few moving parts thereby improving its reliability and efficiency.

SUMMARY OF THE INVENTION

The disadvantages and limitations of prior art can crushers and compactors are obviated while providing an arrangement of components for crushing cans and preventing injury to children or adults.

Apparatus constructed in accordance with the invention effectively crushes aluminum and steel cans by providing a relationship between the size of the hole for receiving the can and the distance and angle between a series of chains carried on sprockets and an inclined plane as will be described hereafter in greater detail. The preferred embodiment disclosed is primarily intended to be used in the home but is also suitable for larger scale operations at a worksite. The arrangement of the crushing elements is also suitable for industrial crushers.

The apparatus includes a support housing having an opening in the upper surface for depositing a can or other article into the compressing mechanism. The mechanism for crushing the cans comprises essentially a conveying arrangement made up of several endless chains. Upper and lower main shafts are journaled to the side walls of the housing and on each shaft have a number of sprockets supporting the endless chains, each chain forming a closed loop.

The sprockets and accordingly the chains are closely spaced to one another such that the chains form an array or belt-like assembly forming a conveying surface. In the preferred embodiment the upper main shaft is directly above the lower main shaft such that the chain loop is essentially vertical. The upper main shaft is connected to a drive means to rotate the conveying chains such that the upper end of the chain loop is the receiving end of the conveyor and the lower end is the discharge end.

An inclined crushing plate cooperates with the chain conveyor to form a crushing or compressing surface adjacent the chains. The crushing plate is arranged such that the lower end of the plate is spaced from the discharge end of the conveyor a distance corresponding essentially equivalent to the desired size of the resulting crushed article. The upper end of the crushing plate is preferrably spaced from the receiving end of the conveyor a distance sufficient to prevent the fingers or hand of a man or child from activating the can crusher and the conveyor chains.

The housing of the apparatus serves to support the crushing mechanism and to shield the moving parts. The opening in the upper surface of the housing is sized according to the type of material being compressed and is disposed at a distance from the angle provided by the conveyor chain and crushing plate sufficient to prevent injury to children. A unit intended for home use is provided with an opening about 2½ inches in diameter whereby a standard 2¼ inch in diameter beverage can is crushed without risk of the operators hands or fingers coming into contact with the moving parts.

The crushing plate is provided with a safety mechanism which is activated by the placement of a can in the opening in the housing. The force of the can falling on to the crushing plate activates a safety mechanism which includes a hinged strip mounted on the crusher plate which actuates an electric switch controlling the electric motor. When a can is dropped into the crushing mechanism the weight of the can depresses the hinged strip to contact the electrical switch thereby starting the motor and conveyor. As the conveyor draws the can downwardly the can is compressed against the crusher plate. The crushed can exits the lower end of the compressing mechanism whereby the hinged strip returns to its original position by a return spring to release the switch causing the conveyor to stop. The safety features of the invention including the safety mechanism greatly reduces the risk of serious injury as the crushing mechanism operates only when a can is placed within the device. The risk of inadvertently starting the crushing mechanism is greatly reduced thereby further reducing the risk of injury.

BRIEF DESCRIPTION OF THE DRAWINGS

Other advantages of the invention will become apparent to those skilled in the art from the following detailed description of the invention in conjunction with the accompanying drawings in which:

FIG. 8 is a front elevational view of the crushing plate and hinged actuator strip according to an alternative embodiment of the present invention;

FIG. 9 is a front elevational view of the hinged actuator strip, electrical switch and return spring according to an alternative embodiment of the present invention; and FIG. 10 is a sectional view taken along line 10—10 of the crushing plate of FIG. 8.

DETAILED DESCRIPTION OF THE INVENTION

The invention is directed to a device primarily intended to be suitable for crushing and flattening any malleable material. In the disclosed preferred embodiment the crushing apparatus is intended for home use to crush metal cans and in particular 2¼ inch in diameter aluminum or steel cans of the type commonly used in the beverage industry.

Figure 2:
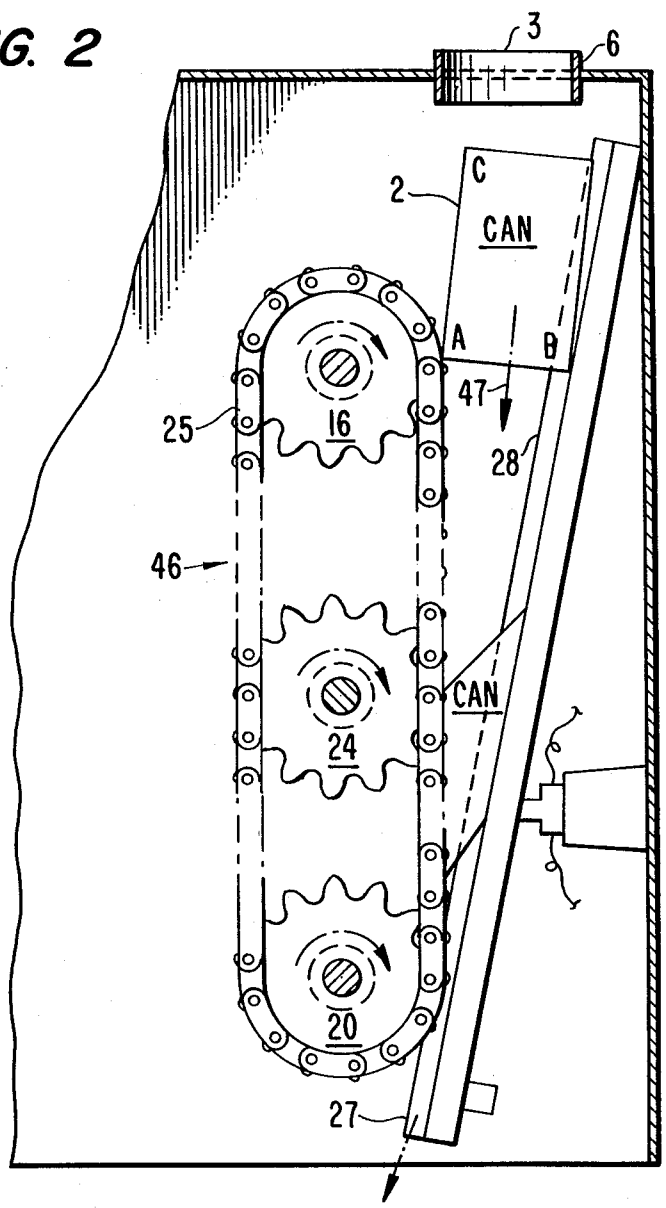
FIG. 2 is a cross sectional view of the apparatus with a portion of the protective housing removed taken along line 2—2 of FIG. 1.
Figure 1:
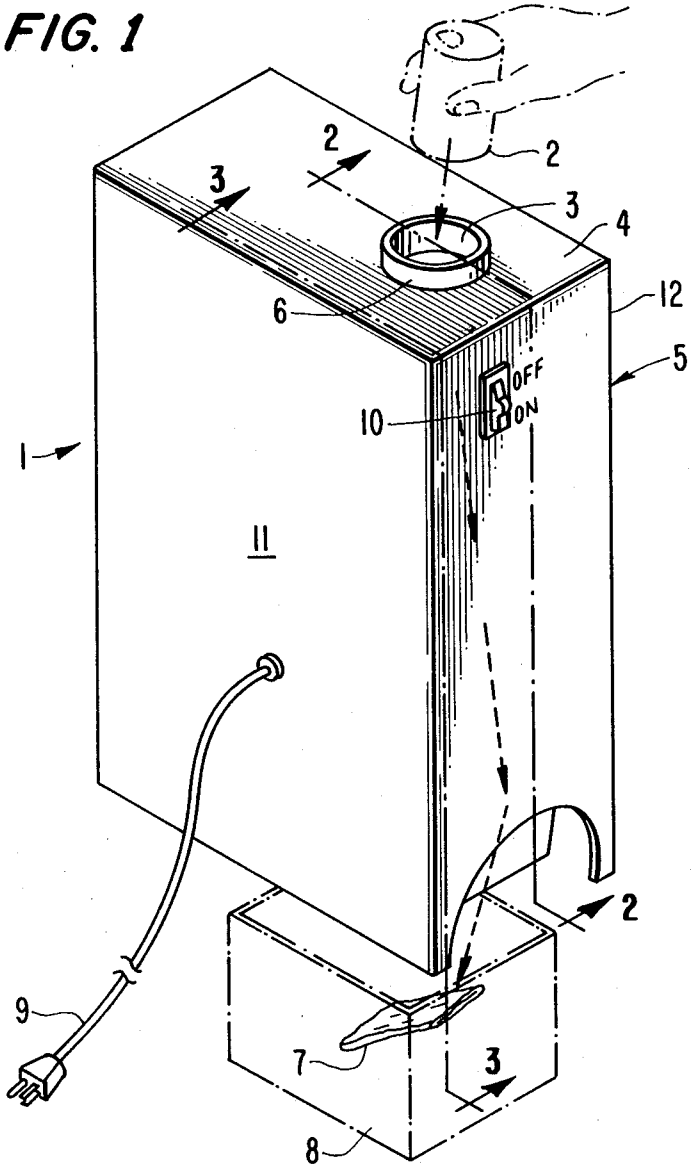
FIG. 1 is a perspective view of the crushing apparatus illustrating the protective housing and can depositing opening constructed in accordance with the invention.

Referring to FIG. 1 the crushing apparatus is represented generally by the numeral reference 1. An opening 3 is provided in the upper surface 4 of the housing 5 for receiving a steel or aluminum food or beverage can 2. A lip or collar member 6 defines the opening 3 and serves to guide the can 2 into crushing engagement with the crushing assembly shown generally as 45. The collar 6 is shown as an annular shaped member and, as depicted in FIG. 2, extends downwardly into the interior of the housing 5 forming a guide or chute to direct the can within the apparatus and toward the crushing assembly 45. An electrical connection 9 to be connected with a suitable power supply and a safety switch 10 are provided to control the operation of crushing assembly 45.

The housing is preferably assembled from individual panels defining an upper surface, side walls 11 and 12 and front and rear walls. The individual panels are fastened together by any suitable means including rivets, screws or welds. It is preferred that at least one panel be readily removable in order to repair and service the crushing assembly 45. Alternatively, the housing 5 may be made as a single unit.

Figure 4:
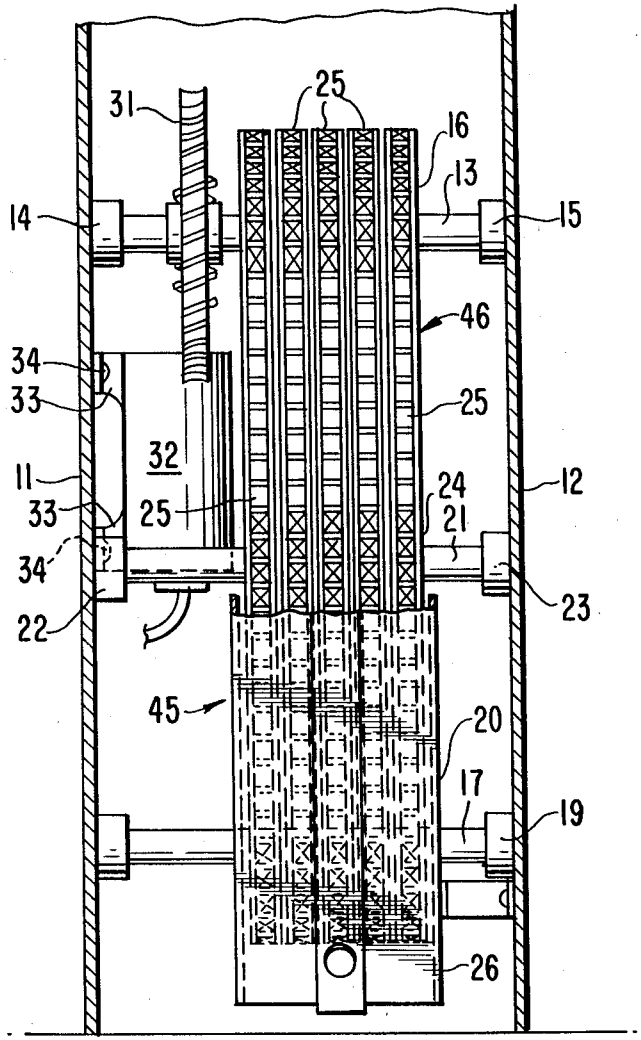
FIG. 4 is a cross sectional view of the apparatus taken along line 4—4 of FIG. 3.

The apparatus as seen in FIG. 4 includes the crushing assembly 45 having an upper drive shaft 13 extending transversely from the side wall 11 to the side wall 12. The shaft 13 is journaled in bearings 14 and 15 which are fixed to the side walls 11 and 12 respectively.

A similar lower main shaft 17 is disposed vertically below the drive shaft 13 in the lower portion of the housing 5. The lower main shaft 17 extends parallel to the shaft 13 and is journaled in bearings 18 and 19 fixed to the side walls 11 and 12 of the housing.

A plurality of sprockets 16 and 20 are mounted on the upper drive shaft and lower main shaft. A plurality of continuous link chains 25 extend from the sprockets 16 to the sprockets 20 thus forming an endless chain conveyor 46. The chains 25 are essentially a conventional continuous link chain with teeth or barbs added thereto. The teeth serve to grip the can effectively during crushing as described hereafter in greater detail. Depending on the intended use of the apparatus the teeth may not be necessary and can be deleted.

In the preferred embodiment at least one idle shaft 21 similarly extends from side wall 11 to side wall 12 and is journaled in bearings 22 and 23 fixed on the side walls. The shaft 21 supports idle sprockets 24 which rotate freely with the chains 25. The shaft in the preferred embodiment is situated parallel to and essentially midway between the drive shaft 13 and lower main shaft 17.

Referring to FIG. 2, the sprockets 16, 19 and 24 are arranged one above the other such that the runs of the chain conveyor are substantially vertical. In an alternative embodiment the sprockets and shafts are arranged such that the runs of the chain conveyor are at an incline.

The crushing assembly 45 further includes a crushing plate 26 disposed within the housing mounted to the side walls 11 and 12 by any suitable means. As shown in FIG. 2, the crushing plate 26 is secured to the walls by L-shaped brackets 29 and rivets 30. Alternatively, the brackets 29 may be fixed to the side walls by screws, spot welds or the like.

The crushing plate 26 is positioned in a nonparallel, inclined relationship to the chain conveyor 46 converging toward the lower end of the chain conveyor. A crushing zone is defined by the area between the crushing plate and the chain conveyor. The upper end 28 of the crushing plate 26 is spaced from the upper end of the chain conveyor 46 and sprockets 16 a distance suitable to receive the can. This distance is preferably the same as the width of the opening 3. A crushing device intended for home use in crushing beverage cans preferably provides an opening of approximately 2½ inches. The crushing plate 26 is inclined with the lower end 27 converging toward the lower end of the chain conveyor and is preferably spaced about ⅜ inch therefrom.

While the crushing plate 26 is shown as being in a fixed position relative to the chain conveyor an alternative embodiment provides that the crushing plate is adjustable. This adjustable feature varies the distance between the crusher plate and conveyor which allows cans or other articles of different sizes to be received and to alter the thickness of the resulting crushed can exiting the crushing assembly. The thickness of the crushed can may be selected according to the guage of metal or type of metal which the can is made from. For example a soft, thin aluminum beverage can may be crushed thinner without strain on the motor than a larger steel can.

Figure 3:
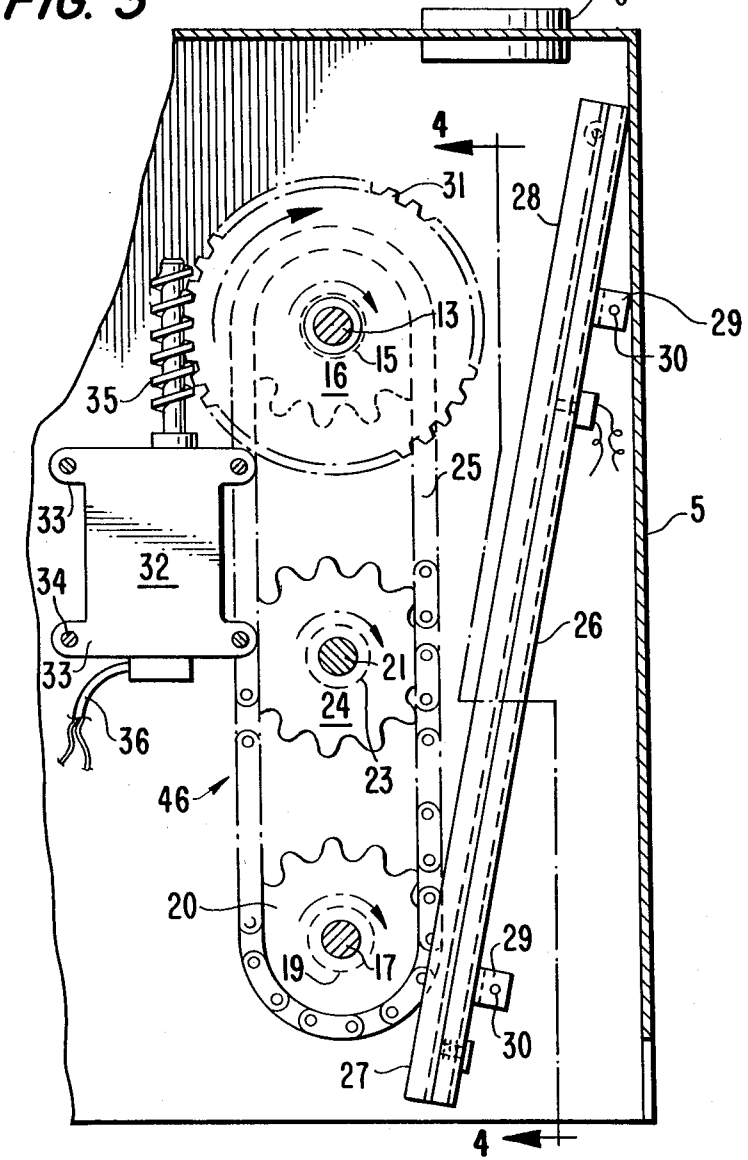
FIG. 3 is a cross sectional view of the apparatus taken along line 3—3 of FIG. 1.

As best shown in FIG. 3, a drive means for the chain conveyor 46 includes a gear 31 mounted on the drive shaft 13. An electric motor 32 is provided with leg members 33 for attachment to the side wall 11 by a suitable fastening means such as a rivet or screw 34. A worm gear 35 is secured to the shaft of the motor 32 which meshes with and imparts a rotation to the gear 31. The motor 32 is connected to a suitable power source by an electrical wire 36. Although the motor 32 in the preferred embodiment is an electric motor it is recognized that the drive means may include any type of motor, such as for example an hydraulic motor. The size of the motor and the ratio of the gears 31 and 35 are selected according to the requirements of the intended use of the crushing apparatus and the force needed for the material being crushed.

In operation, as best shown in FIG. 2, a can 2 is dropped through the collar 6 where it enters the crushing zone between the chain conveyor 46 and converging crushing plate 26. The collar 6 and the upper surface 4 of the housing are spaced a suitable distance above the crushing apparatus to reduce the risk of injury by the user's hand or fingers contacting the crushing assembly. When the motor 32 is operated the chains of the chain conveyor engage the can 2 drawing it downward in the direction of arrow 47 toward its discharge end. As the can 2 is drawn downwardly through the crushing zone the can is flattened. The resulting flattened can 7 exits the crushing assembly 45 where it is deposited in a receiving tray 8.

Figure 5:
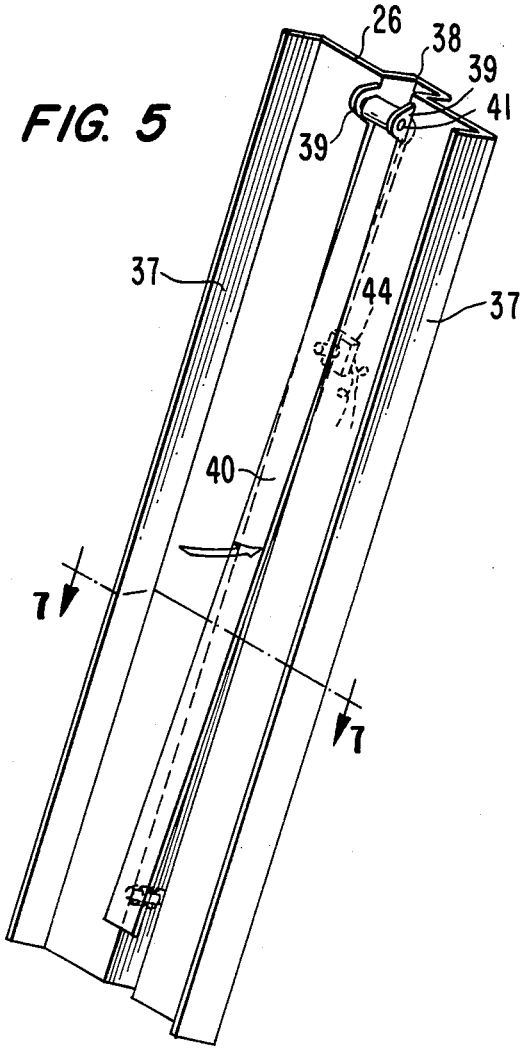
FIG. 5 is a front elevational view of the crushing plate and hinged actuator strip in accordance with a preferred embodiment of the present invention.
Figure 6:
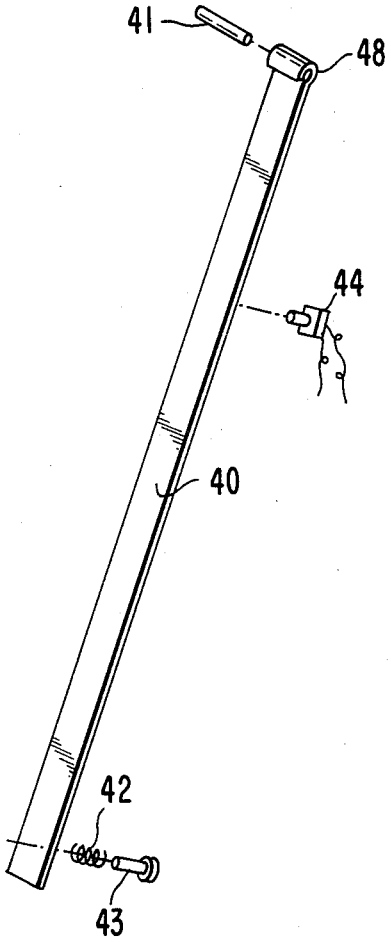
FIG. 6 is a front elevational view of the hinged actuator strip, electrical switch and return spring.
Figure 7:
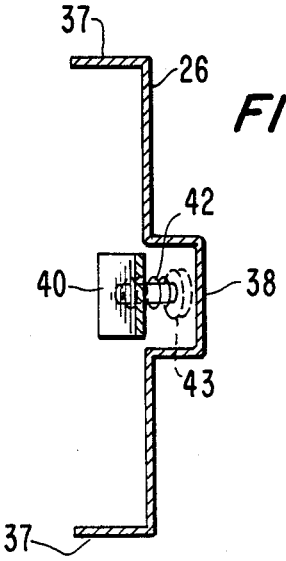
FIG. 7 is a sectional view of the crushing plate taken along line 7—7 of FIG. 5.

An additional feature of the invention includes safety features to avoid the risk of injury to the operator. As best shown in FIGS. 5 and 7 the crushing plate 26 is provided with upturned flanges 37 extending the length of the plate to guide the can 2 through the crushing zone. The crushing plate 26 further includes an essentially U-shaped trough 38 extending the length of the plate. At the uppermost end of the crusher plate 26 a pair of opposing support brackets 39 project outwardly as seen in FIG. 5. An actuating member 40 comprising a strip of suitable material the length of the trough 38 is pivotally mounted between brackets 39. As shown in FIG. 6 the actuator 40 includes a closed loop 48 at one end which receives a hinge pin 41 extending between the pair of brackets 39. At the lower end of the trough 38 a return spring 42 urges the lower end of the actuator 40 outwardly away from the crusher plate 26. A pin-like member 43 is secured to the bottom of the trough 38 and supports the spring 42. In the rest position the actuator 40 is urged outwardly by the spring 42 as shown in FIG. 5.

An electrical switch means 44 is mounted in the trough 38 for controlling the drive motor 32. The switching means 44 is positioned such that the swinging movement of the actuator 40 towards the crushing plate 26 will actuate the switch 44. When a can 2 is dropped through the opening 3 in the housing the can will engage the actuator 40. The weight of the can is sufficient to depress the actuator 40 and actuate the switch 44 thereby supplying power to the motor 32 to drive the chain conveyor 46. In the manner described above the chains engage the can drawing it through the crushing zone between the chain conveyor 46 and the converging crushing plate 26. As the flattened can 7 exits the crushing assembly 45, the actuator returns to its rest position and the switch 44 is released to stop the motor 32. This automatic switching mechanism provides convenience of operation and serves to prevent accidental injury should a child or other person place their hand or fingers through the opening 3. The safety switch 10 mounted on the outside of the housing may also be provided as a master control for the motor 32 in the event of a jam or other malfunction. The switch 10 appears in FIG. 1. on the front panel 12 however the switch can be positioned on the sides or rear as desired.

A preferred alternative embodiment of the crushing plate, actuator and electrical switch is shown in FIG. 8 and FIG. 9. In this embodiment a crushing plate 126 attached to the side walls of the housing includes an essentially flat crushing surface 128. Upturned edges 137 extend the length of the plate to guide the can through the crushing zone. Pivotally connected to the lower end of the crushing plate 126 is an actuator 140 for engaging an electrical switch 144. As best shown in FIG. 8. a pair of upstanding brackets 139 extend from the lower end of the plate 140 each having an aperture to receive a hinge pin 141. The actuator 140 is comprised of a strip of suitable sized material being disposed substantially the length of the plate 128. As shown in FIG. 9. a closed loop 148 is formed at the lower end of the actuator to secure the hinge pin 141 which when received in the brackets 139 retain the actuator in place. The upper end of the actuator 140 is not restricted at the upper end so as to float freely.

Extending through the plate as shown in FIG. 10 is a spring actuated button 146 of the electrical switch 144. A coil spring 142 surrounds the button and serves as a return spring to urge the actuator 140 away from the plate 126. Alternatively the switch and button arrangement may be provided with an internal spring of suitable strength to serve as a return for the actuator. In the preferred form the switch is positioned in the lower portion of the upper third of the plate 126.

The function of the crushing plate and actuator are essentially as outlined above. A can entering the collar 6 falls onto the plate 126 and actuator 140 causing the actuator to pivot inwardly depressing the button 146 of switch 144. The switch 146 being connected to the motor starts the chain conveyor which grips the can and draws it downwardly between the conveyor and crushing plate 126. As the can is discharged from the area between the conveyor and the plate the spring 142 returns the actuator to its rest position away from the plate 126 thereby disengaging the switch 144.

In an alternative embodiment the mounting brackets supporting the actuator 40 may be disposed within the trough 38 such that the brackets and upper end of the actuator do not project above the crushing surface of the plate 26. Additionally the hinge pin 41 may be mounted between the side walls of the trough 38 thereby eliminating the need for the support brackets.

Other embodiments of the invention will be apparent to those skilled in the art from consideration of the specification and practice of the invention disclosed herein. It is intended that the specification and examples be considered as exemplary only, with the true scope of the invention being indicated by the following claims.

What is claimed is:

1. A crushing apparatus comprising:

(a) a housing having an intake end and a discharge end;

(b) a flexible chain having a barbs thereon forming a barbed conveyor disposed in said housing operatively connected to a first set of sprockets disposed at said intake end of said housing, and a second set of sprockets disposed at said discharge end of said housing;

(c) a substantially rectilinear fixed crushing plate inclined with respect to said flexible chain conveyor, and extending from the intake end of said housing to said discharge end of said housing;

(d) a resiliently mounted actuator strip disposed substantially parallel to said fixed crushing plate and pivotally mounted to said fixed crushing plate at said discharge end of said housing, and extending substantially the length of said crushing plate and operatively connected to an actuator switch means for activating said flexible barbed chain conveyor, so that a beverage can is flattened by said combination of said crushing plate, said flexible barbed chain conveyor and said resiliently mounted actuator strip to leave the top and bottom of the can exposed; and (e) a dimensioned circular opening said housing of a diameter sufficient to accept beverage cans, and disposed in said housing at a distance away from said first set of sprockets and said fixed crushing plate to prevent injury to a user of said apparatus.

2. The crushing apparatus according to claim 1 wherein said flexible chain conveyor is disposed substantially vertically.

3. The crushing apparatus according to claim 1 wherein said actuator switch means is disposed behind said actuator strip.

4. The crushing apparatus according to claim 4 further comprising a main switch for overriding said actuator switch means.

5. The crushing apparatus according to claim 4 wherein said actuator switch means includes a return spring for said actuator strip.

6. The crushing apparatus according to claim 5 wherein said crushing plate includes upturned flanges on the sides extending the length of the plate for guiding an article to be crushed.

7. The crushing apparatus according to claim 1 wherein said fixed crushing plate includes a longitudinal recess for carrying said pivotally mounted actuator strip.

8. The crushing apparatus according to claim 5 wherein said actuator strip is pivoted by the weight of an article to be crushed.

9. The crushing apparatus according to claim 6 further comprising a return spring for said actuator strip.

10. A crushing apparatus comprising;

(a) a housing having a receiving end and a discharge end;

(b) a plurality of resilient chains having barbs forming a barbed conveyor means disposed between said receiving end and said discharge end of said housing;

(c) a fixed crushing surface inclined with respect to said barbed conveyor means, and extending from the receiving end of said housing to the discharge end of said housing;

(d) a switch means for activating said barbed conveyor means;

(e) an actuator strip pivotally mounted to said fixed crushing surface adjacent to said discharge end of said housing, and extending substantially the length of said crushing plate so that said conveyor means is activated by the weight of a can to be crushed causing a pivoting of said actuator strip which activates said switch means so that a can is flattened to leave the top and bottom of the can exposed by the cooperation between said barbed conveyor, said actuator strip and said fixed crushing surface; and (f) a dimensioned opening in said housing to receive said article said opening being, disposed at a distance away from said barbed conveyor means and crushing surface to prevent injury to a user of said apparatus.

* * * * *